US005398535A

United States Patent [19]

Giffin

[11] Patent Number: 5,398,535

[45] Date of Patent: Mar. 21, 1995

[54] SPREADER CLAMP FOR AUTOMOBILE BODY REPAIR AND THE LIKE

[76] Inventor: Roger E. Giffin, Suite 118-1635 Martin Drive, Surrey, British Columbia, Canada, V4A 6C9

[21] Appl. No.: 120,512

[22] Filed: Sep. 14, 1993

[51] Int. Cl.[6] ..... B21D 1/12

[52] U.S. Cl. ..... 72/392; 72/705

[58] Field of Search ..... 72/392, 705; 81/302

[56] References Cited

U.S. PATENT DOCUMENTS

| | | | |
|---|---|---|---|
| 2,280,005 | 4/1942 | Petersen | 81/84 |
| 2,283,089 | 5/1942 | Pfauser | 254/104 |
| 2,447,401 | 8/1948 | Ferguson et al. | 81/15 |
| 2,514,130 | 7/1950 | Jones | 81/84 |
| 2,585,158 | 2/1952 | Morgenthaler | 72/392 |
| 2,588,509 | 3/1952 | Forster | 153/39 |
| 2,606,469 | 8/1952 | Morgenthaler | 81/15 |
| 2,769,358 | 11/1956 | Hill | 72/392 |
| 3,347,084 | 10/1967 | Flower | 72/457 |
| 3,541,835 | 11/1970 | Hunnicutt | 72/446 |
| 3,654,755 | 4/1972 | Bell | 81/302 |
| 4,116,035 | 9/1978 | Malarsky | 72/389 |
| 4,358,946 | 11/1982 | Gallart | 72/392 |
| 4,373,373 | 2/1983 | Schaefer | 72/413 |
| 4,541,312 | 9/1985 | Petersen | 81/367 |
| 4,831,905 | 5/1989 | Murchison | 81/485 |

*Primary Examiner*—Lowell A. Larson
*Attorney, Agent, or Firm*—Bull, Housser & Tupper

[57] ABSTRACT

A lockable spreader clamp comprises first and second handle portions for gripping by an operator and first and second arm portions extending therefrom. Outer portions of the arm portions have contact pads thereon for engaging a work piece. Inner portions of the arm portions are hinged together and cooperate with the handle portions so as to be responsive to movement thereof, so that movement of the handle portions towards each other causes the outer arm portions to move away from each other. The arm portions are locked to engage the work piece when the handle portions are moved towards each other to activate a locking structure, and can be released from a locked position by activating a releasing structure. The invention can be positioned in a narrow space between two members of a work piece using one hand, and can be locked in position so as to be self-supporting and leave the operator's hands free. When so locked, the clamp can provide an anvil for hammering against. Alternatively, the clamp can be operated to apply a series of outwardly directed forces at incrementally increasing spacing due to a mechanical magnification inherent in the clamp.

17 Claims, 3 Drawing Sheets

SPREADER CLAMP FOR AUTOMOBILE BODY REPAIR AND THE LIKE

BACKGROUND OF THE INVENTION

The invention relates to a spreader clamp for use in automobile body repair to straighten dents and other damage to panels of a motor vehicle and the like.

In automobile body repairing, dents to body panels, fenders and the like can sometimes be straightened by forcing the dented panel outwardly to resume its normal position, using bars, mallets, etc. if there is sufficient room adjacent an inside face of the panel to apply sufficient force. Sometimes an inner panel or other interior structure is spaced closely from a dented outer panel and there is insufficient room to hammer the dented outer panel. In such instances, it is known to use a specific type of body repair spreading tool which can be inserted in the space between the inner and outer panels to apply force to the outer panel. The device has contact pads which can be forced against the inner and outer panels to apply an outwards force to the outer panel to move it to the original or desired position, or to serve as an anvil for hammering against to work the panel as desired. There are various classes of tools to effect the above, and these can be classified as mechanically actuated or hydraulically actuated.

Typical mechanical devices are exemplified in U.S. Pat. No. 2,606,469 (Morgenthaler). In this patent, a pair of hinged arms having pads at outer ends are forced apart by screw threaded members which provide an efficient mechanical advantage. Turning one of the screw threaded members requires a wrench, and this can be awkward to use in a restricted space. Also, as the device is tightened, greater force is required to turn the first threaded member, and this greater force must be resisted by holding the second threaded member which otherwise can twist the device out of alignment, causing the force to be applied in the wrong locations. Additionally, the contact pads are supported generally perpendicularly from behind on short arms subjected generally to compression, which provide little resilience. Consequently, as the metal is worked, forces between the pads decreases rapidly, which necessitates frequent re-adjustment of the screw threaded members to maintain the outwardly directed force. This device can be very time consuming to use.

Devices utilizing hydraulic fluid are shown in U.S. Pat. Nos. 2,588,509 (Forster); 2,447,401 (Ferguson et al) and 2,283,089 (Pfauser) which all use a pair of hinged arms in a scissor-type device. U.S. Pat. No. 4,358,946 (Gallart) generates mechanical forces by using hinged wedges forced apart by a hydraulic ram. While devices of this general type function adequately in some instances, they tend to be heavy and bulky, and some have limited travel. In addition, hydraulic tools tend to be more costly initially than mechanical devices, and there are added complication of increased service cost due to possible hydraulic fluid leakage, etc. Hydraulic devices require either a powered pressurized hydraulic fluid service which can be costly, or individual manual pumping which is commonly a two-handed operation, so that the operator is not free to handle other tools at the same time.

The other devices for assisting in body repair include a dent puller as shown in U.S. Pat. No. 4,116,035 (Malarsky). Several embodiments of this apparatus are shown in which at least two legs engage portions of the body remote from the dent, and a puller rod engages a hole in the dented panel to pull the panel outwardly against a reaction force from the legs. In one embodiment, a pair of adjustable, locking compound hand pliers are used to move the pulling rod in increments, the pliers providing mechanical advantage and locking ability which frees the operator's hands. This device usually requires drilling at least one hole in the dented panel, which aggravates rusting of the panel. U.S. Pat. No. 4,373,373 (Schaefer) discloses an automobile body repair tool which is affixed to one jaw of adjustable compound locking hand pliers which are generally similar to those shown in the patent to Schaefer and provide mechanical advantage for squeezing to deform the material and remaining locked on the panel, which frees the operator's hand. This apparatus is for forming off-set shoulders around an opening in a metal sheet to provide an off-set portion surrounding a cut-out or damaged area to permit application of a patch which would be flush with the original body work.

The patents to Malarsky and Schaefer disclose compound pliers which resemble the well-known lockable and adjustable compound hand pliers as manufactured by Peterson Manufacturing. Co. Inc. of Nebraska, USA, and sold under the registered trademark VISE GRIP. Such pliers are disclosed generally in several U.S. Pat. Nos. for example: 2,280,005 (Petersen); 2,514,130 (Jones) and 4,541,312 (Petersen). These pliers have oppositely facing hinged jaws which can be forced inwardly towards each other under a mechanical advantage by squeezing handle portions together, and then locked in a gripping position to leave the operator's hands free.

To the inventor's knowledge, there are no lightweight, portable and relatively low cost mechanical devices available which can be inserted in a relatively narrow space between two panels, one of which requires forcing outwardly, which can be used to provide a mechanical advantage for forcing the panel outwardly, and to provide locking ability to free the operator's hands for hammering the panel, or for other tasks.

SUMMARY OF THE INVENTION

The invention reduces difficulties and disadvantages of the prior art by providing a lockable spreader clamp which can be installed in a space between two members, hereinafter work piece, at least one of which requires working to enable an outwardly directed force to be applied to the two members. The spreader clamp is operable with one hand for installation in the space, applying an outwards force to the members, followed by locking in the space. In addition, the clamp is a simple mechanical, low cost portable device which is compact and can be inserted easily into relatively small spaces using only one hand. In addition, because it is mechanical it does not require hydraulic fluid, thus eliminating some of the problems of the prior art hydraulic devices. In addition, portions of the present clamp closely resemble portions of prior art compound lockable hand pliers which are well established and thus some of the tooling is easily available to simplify design and manufacturing, thus reducing costs, and in some instances, inventory of spare parts.

A lockable spreader clamp according to the invention comprises first and second handle portions, first and second arm portions, a locking means and a releasing means. The first and second handle portions are for gripping by an operator to move to a locked position of the clamp. Each arm portion has respective outer and inner arm portions, the outer arm portions having contact pads thereon for engaging a work piece. The first and second inner arm portions cooperate with the first and second handle portions respectively so as to be responsive to movement of the handle portions. In this way, movement of the handle portions towards each other causes the outer arm portions to move away from each other. The locking means are for locking the arm portions engaged with the work piece when the handle portions are moved towards each other. The releasing means are for releasing the handle portions from the locked position. The releasing means cooperate with the handle portions and the locking means to permit the arm portions to be released from engagement with the work piece.

Preferably, an inner portion of the first handle portion and the first inner arm portion are rigidly connected together to form an essentially rigid unitary elongated structure. Also, an inner portion of the second handle portion is hinged to the second inner arm portion at a handle hinge having a handle hinge axis to permit hinged relative movement thereabouts.

Preferably, the first and second arm portions are hinged for relative rotation about an arm hinge having an arm hinge axis. The arm portions and the contact pads can be disposed symmetrically about a plane disposed perpendicularly to the arm hinge axis so as to reduce asymmetrical forces on the arm portion when the pads engage the work piece.

A detailed disclosure following, related to drawings, describes a preferred embodiment of the apparatus, which is capable of expression in structure other than that particularly described and illustrated.

BRIEF DESCRIPTION OF THE DRAWINGS

In drawings which illustrate a preferred embodiment of the invention.

DETAILED DESCRIPTION

FIGS. 1-3

Figure 1:
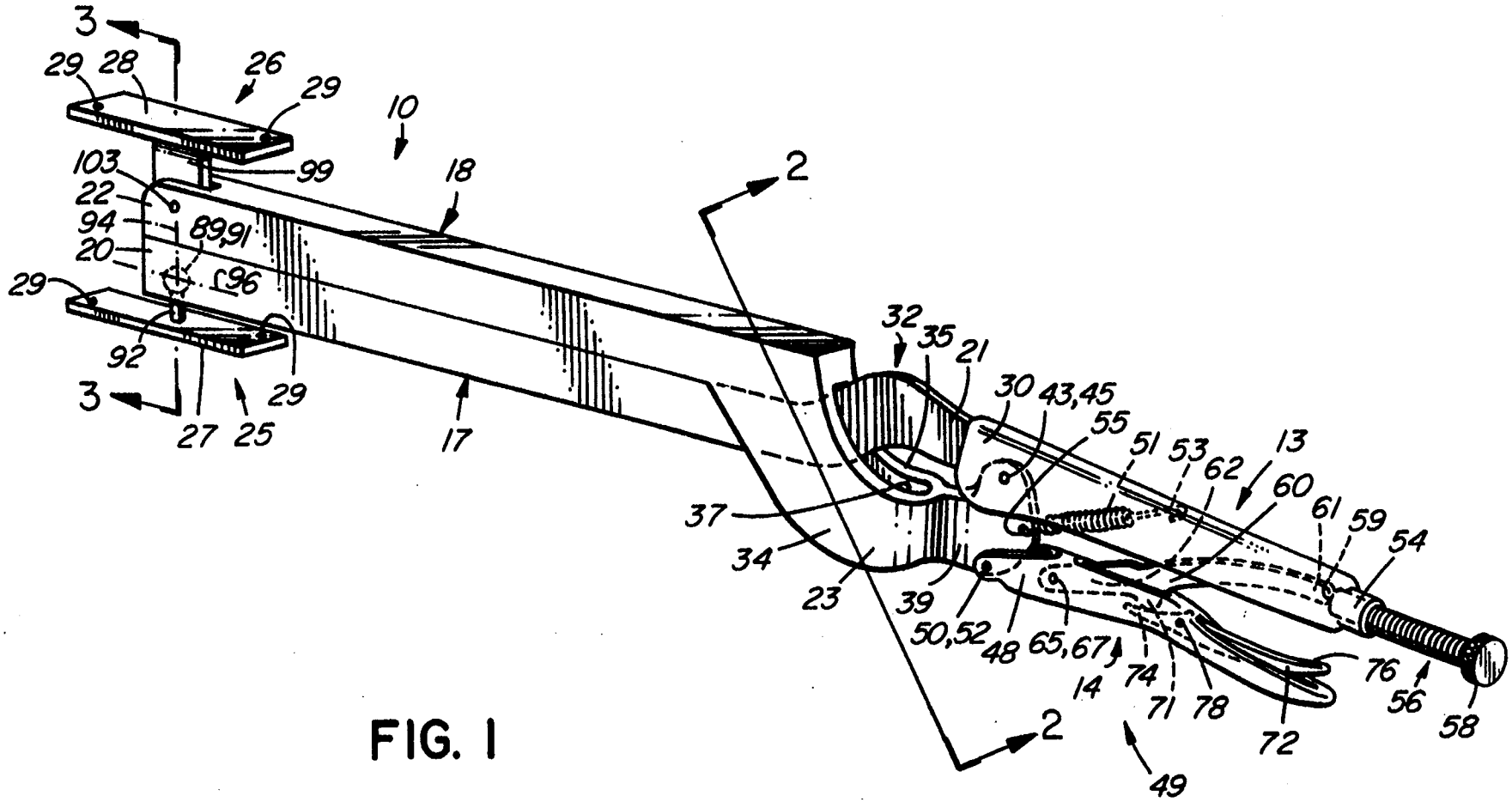
FIG. 1 is a simplified perspective of the invention shown with the arm portions locked in a retracted position, i.e. the arms being closest to each other, some hidden detail being shown.
Figure 5:
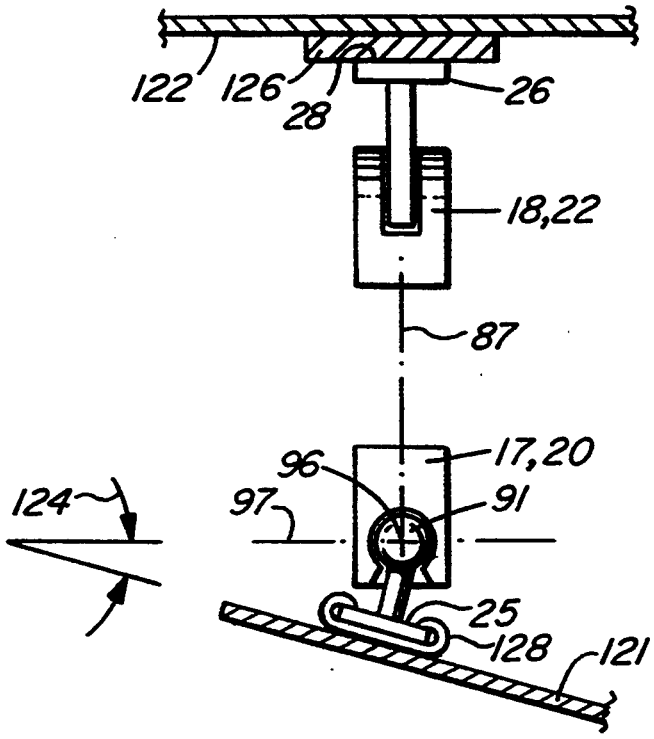
FIG. 5 is a simplified diagrammatic end view of end portions and contact pads adjacent a work piece with non-parallel surfaces of members.

Referring mainly to FIG. 1, a lockable spreader clamp 10 according to the invention comprises first and second handle portions 13 and 14 respectively for gripping by an operator to move to a locked position as shown. The clamp further comprises first and second arm portions 17 and 18, the arm portion 17 having outer and inner arm portions 20 and 21, and the arm portion 18 having outer and inner arm portions 22 and 23. The first and second outer arm portions 20 and 22 have respective first and second contact pads 25 and 26 which have outwardly facing work surfaces 27 and 28 respectively to contact oppositely facing surfaces of a work piece as will be described with reference to FIG. 5. The pads 25 and 26 have openings 29 to receive fasteners for securing optional load dispersal pads and friction pads thereto, as shown in FIG. 5. An inner portion 30 of the first handle portion 13 and the first inner arm portion 21 are rigidly connected together to form an essentially rigid unitary elongated structure extending as a generally straight line except for a curved neck portion 32 generally adjacent the inner arm portion 21. The portion 32 is of a thinner rectangular cross-section than the remaining portions of the arm portion 17 and handle portion 13 as will be described.

Figure 2:
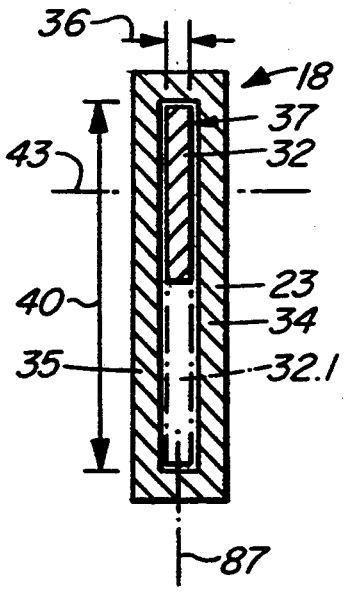
FIG. 2 is a simplified, oblique cross-section of an intermediate portion of the clamp, as seen from line 2—2 of FIG. 1.

The outer portions 20 and 22 are generally rectangular cross-sectioned straight bars which permit placing closely adjacent each other as shown to facilitate insertion of the arm portions into a narrow opening as sometimes encountered in bodywork repairs. The inner arm portion 23 of the arm portion 18 is bifurcated and has a pair of laterally spaced apart branch portions 34 and 35 which are spaced apart to provide a clearance opening 37 therebetween having a width 36. The branch portions are flat, plate-like portions which extend from the rectangular sectioned portion of the second arm portion 18 on opposite sides of the clearance opening 37 and are reconnected at a trunk portion 39 of the inner arm portion 23 which has a relatively deep rectangular section. The width 36 of the clearance opening 37 is greater than thickness of the curved neck portion 32 of the first arm portion to receive the portion 32 passing freely therethrough. The clearance opening 37 has a depth 40 which is sufficient to permit lateral movement of the curved neck portion 32 relative thereto to move the arm portions away from each other to assume a broken outline position 32.1 (FIG. 2), and to move towards each other as will be described. Thus, it can be seen that one of the arm portions, namely the second arm portion 18, has the clearance opening 37, which serves as a clearance means to receive the other arm portion, namely the first arm portion 17, passing therethrough. The opening in the second arm portion has a size to receive the first arm portion passing freely therethrough and provides clearance for relative movement between the arm portions in response to movement of the handle portions as will be described with reference to FIG. 4.

The trunk portion 39 has an innermost first hinge portion hinged to the first handle portion 13 by a sturdy first hinge pin 43 which passes through appropriate aligned openings in the first handle portion and the trunk portion. Preferably, the first handle portion 13 has a U-shaped cross section when viewed endwise, the cross-section having two cheek portions, only one being shown, which are spaced apart sufficiently to receive the trunk portion therebetween. Aligned openings in the cheek portions and trunk portion receive the hinge pin 43 to provide an arm hinge 45. Thus, the first and second arm portions 17 and 18 are hinged for relative rotation about the arm hinge 45 having an arm hinge axis centered on the hinge pin 43.

The second handle portion 14 has an inner portion 48 having a generally U-shaped cross section when viewed end wise, the cross-section having two generally parallel cheek portions, one only being shown, which are spaced apart sufficiently to receive an outer portion of the trunk portion 39 therebetween. Aligned openings in the cheek portions and the outer portion of the trunk portion 39 receive a second hinge pin 50 passing therethrough, the hinge pin 50 being parallel to the hinge pin 43. Thus, the inner portion 48 of the second handle portion is hinged to the second inner arm portion 18 at a handle hinge 52 having a handle hinge axis coincident with the second hinge pin to permit hinged relative movement thereabouts.

Portions of the spreader clamp including and disposed to the right hand side of the trunk portion 39, the arm hinge 45, and the handle hinge 52 can be essentially identical to the previously described, patented, adjustable, lockable compound hand pliers, commonly sold under the registered trade-mark "Vise Grip", which portions can be termed collectively herein as hand plier assembly 49. Relevant portions of the previously recited "Vise Grip" patents are incorporated herein by reference but, for completeness, portions of this well known device that are common to the invention will now be briefly described. While the locking and adjustability structure of the plier assembly 49 is generally similar to the Vise Grip", the action with respect to the first and second arm portions is opposite to the "Vise Grip" as follows. The contact pads 25 and 26 of the present invention apply an outwardly directed force, whereas the conventional plier jaws found on the "Vise Grip" apply an inwardly directed force. Thus it can be seen that the first and second inner arm portions cooperate with the first and second handle portions respectively so as to be responsive to movement of the handle portions, in which movement of the handle portions towards each other causes the outer arm portions to move away from each other.

A tension coil spring 51 has an inner end 53, broken outline, secured to the first handle portion, and an outer end 55 secured to the trunk portion 39. The spring applies an anticlockwise force to the trunk portion 39 about the arm hinge 45, tending to draw the first and second arm portions together as shown. This facilitates inserting the clamp into a narrow opening, and prevents inadvertent or premature extension or opening of the clamp when held in a locked position. The spring 51 thus serves as a resilient means extending between the second arm portion and an adjacent portion of the essentially rigid unitary elongated structure of the first arm portion and first handle portion, and resiliently urges the contact pads inwardly towards each other.

An outer end of the first handle portion 13 is formed to have an internally threaded opening 54 which is aligned with the first handle portion and receives an adjusting screw 56 which has a knurled outer end 58 to facilitate turning by the operator. The screw 56 has an inner end 59, broken outline, having a relatively flat circular face, and clearly, rotation of the screw 56 by the operator moves the inner end 59 relative to the handle.

A latching member 60 extends between the first and second handle portions 13 and 14 respectively, and is a generally flat, narrow and straight link which can be received in the gap between the cheek portions of the respective first and second handle portions so as to be unobtrusive when the first and second handle portions are gripped by the operator. The latching member 60 has a first end portion 61 and a second end portion 62, both shown in broken outline. The first end portion 61 engages the inner end 59 of the adjusting screw 56 which serves as a latch stop and serves to locate the first end portion of the latching member with respect to the first handle portion 13 as will be described. The second end portion 62 is hinged to the second handle portion 14 at a latch hinge 65 having a latch hinge pin 67 coincident with a latch hinge axis, the hinge 65 permitting relative rotation between the latching member and the second handle portion. The latch hinge axis and the arm hinge axis are parallel to each other. The latching member 60 has undesignated inner and outer edges, the outer edge having a projection 71, broken outline, which extends towards the second handle portion 14.

A releasing lever 72 has an inner end 74 positioned so as to be contacted by the projection 71 of the latching member, and an outer end 76 positioned between the handle portions for easy contact by the operator. A lever fulcrum 78 hinges the lever 72 to the second handle portion 14 so as to permit the releasing lever to rock about the fulcrum relative to the handle portion. When the handles are closest towards each other in the locked position as shown, the inner end 74 is pressed by the projection 71 against the second handle portion, and the outer end 76 of the lever 72 is in a raised position.

Figure 3:
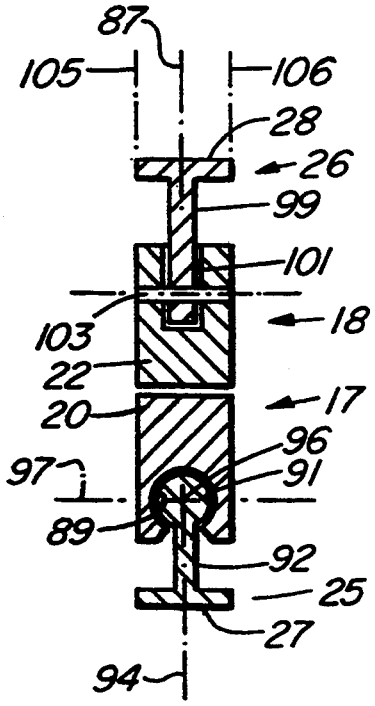
FIG. 3 is a simplified cross-section of outer end portions of the arm portions on line 3—3 of FIG. 1.

Referring to FIG. 3, the arm portions 17 and 18 are disposed symmetrically about a plane of symmetry 87 which is disposed perpendicularly to the arm hinge axis which is concentric with the first hinge pin 43. The contact pads 25 and 26 are coupled for rotation with respect to the respective arm portions 17 and 18 as follows, so as to accommodate relative inclination of workpiece surfaces when clamped thereagainst as will be described. The outer arm portion 20 has a partially spherical internal recess 89 which receives a ball 91 which is connected to the first contact pad 25 by a stem 92, thus providing a universal joint, ball joint, or knuckle joint for the first contact pad 25. The universal joint has three axes fixed relative to the arm and intersecting each other at a centre of the recess 89; namely a first swivel axis 94 disposed normally to the arm hinge axis, i.e., the hinge pin 43, and mutually perpendicular second and third swivel axes 96 and 97, which are also disposed perpendicularly to the first axis 94. As will be described with reference to FIG. 4, the ball 91 can rotate at least partially about any or all the swivel axes simultaneously, so that the pad can be non-parallel to the arm hinge axis to accommodate non-parallel surfaces of a work piece.

The second contact pad 26 has a fin member 99 extending perpendicularly therefrom to be received in a slot 101 disposed at the outer arm portion 22. A contact pad hinge pin 103 passes through openings in side walls of the slot 101 and through an opening in the fin member to hinge the contact pad for rotation about a pad axis which is concentric with the contact pad hinge pin 103 and disposed parallel to the arm hinge axis.

As seen in FIG. 3, when the pad 25 is disposed symmetrically of the axis 94, the pads are located symmetrically relative to each other so that generally adjacent oppositely facing edges of the pads are located within planes 105 and 106 which are generally parallel to the plane 107 and spaced apart at the width of the arm portion. The pads have generally equal widths which are equal to widths of the first and second arm portions 17 and 18 so that edges of the pads are generally flush with sides of the arms. Thus, the pads can be positioned to be generally co-planar with each other so as to reduce asymmetrical or off-axis forces on the arms when the pads engage the work piece as will be described. A transverse axis, not shown, passing across the surface 28 of the contact pad 26 is generally parallel to the arm hinge axis, and any lateral swivelling necessary to accommodate oblique surfaces is made by the pad 25 mounted on the knuckle joint as shown. Clearly, for increased versatility, in a first alternative, each contact pad could be provided with a knuckle joint as shown for the first contact pad, or in a second alternative, for a simpler but less versatile arrangement, each contact pad could be provided with a simple hinge as shown for the second contact pad.

OPERATION

FIGS. 1-5

Figure 4:
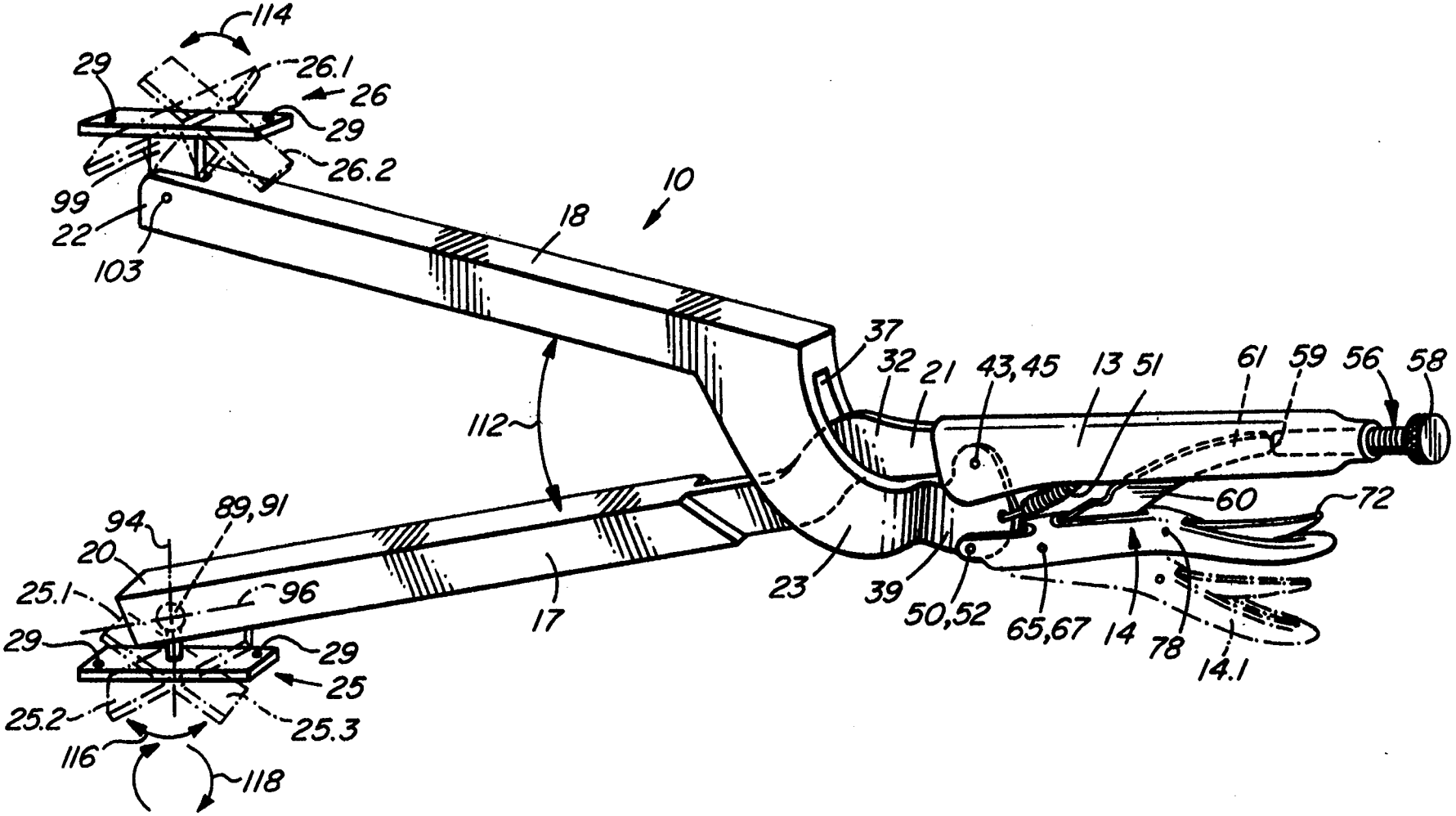
FIG. 4 is a simplified perspective view generally similar to FIG. 1 with the arm portions locked in an extended position, i.e. the arms being furthest apart from each other.

Referring to FIG. 1, when the adjusting screw 56 is at a maximum extension from the first handle portion 13 as shown, the first and second arm portions 17 and 18 are closest to each other, and space between the work surfaces 27 and 28 of the contact pads is a minimum. This position provides a minimum lateral dimension for the clamp, to permit the arm portions to be inserted into narrow openings as can be sometimes encountered with automobile body work. Consequently, for many applications the operator will unscrew the screw 56 to the extended position as shown, so as to permit essentially complete contraction of the clamp as shown in FIG. 1 for initial insertion into a narrow opening. When the clamp is within the opening, one of the work surfaces 27 or 28 is positioned adjacent a portion of the automobile body requiring work, which is typically a thin gauge outer panel, and the other work surface is positioned closely adjacent an opposite portion, usually a frame member or inner panel, which is used as a reaction member. As the clamp can be inserted in the opening by the operator using one hand only , it is possible to use the remaining hand to assist in locating the work surfaces at required locations, e.g. by taking suitable measurements to ensure correct installation of the clamp, holding an inspection lamp, etc. When the pads are located in correct positions, the screw 56 is rotated by the remaining hand so that the inner end of the screw moves inwardly, acting on the latching member 60 which in turns acts through the handle portion 14 on the trunk portion 39, tending to rotate the portion 39 in a clockwise direction about the arm hinge 45. This causes the contact pads 25 and 26 to separate as the arm portions 17 and 18 move away from each other to approach an extended position with the arm portions inclined at an angle 12 to each other, as shown in FIG. 4. In this position, it can be seen that the curved neck portion 32 has moved from an upper position in the clearance opening 37, (FIGS. 1 and 2), towards a lower position in the opening, an extreme lower position being designated 32.1 and shown in broken outline in FIG. 2. Limit of movement of the arms with respect to each other is determined, in general, by interference between edges of the portion 32 and the clearance opening 37.

In FIG. 4, the contact pad 26 is shown in broken outline in two extreme inclined positions designated 26.1 and 26.2. The positions represent limits of rotation of the contact pad about the pad hinge pin 103 through an angle 114 which is usually suitable to accommodate many jobs. Clearly, in all positions of the pad 26, opposite longitudinal edges of the pad 26 will be generally co-planar with the planes LOS and 106, in FIG. 3.

Similar extreme inclined positions of the contact pad 25 are shown in FIG. 4 in broken outline at 25.1 and 25.2. The universal joint provided by the ball 91 and the recess 89 permits the stem 92 to swivel about the third swivel axis 97 (FIG. 3), which is disposed parallel to the arm hinge pin 43, so that the two positions 25.1 and 25.2 are disposed at an angle 116 to each other, similarly to the pad 26. In contrast, the pad 21 can also be rotated as shown by arrows 118 about the first swivel axis 94 to assume a broken outline position 25.3 wherein a longitudinal axis of the pad is disposed generally normally to the arm portion 17, or it can rotate about the axis 94 to attain any intermediate angle. In addition, the pad can be swung about the second swivel axis 96 (FIG. 4) so as to be inclined obliquely to a longitudinal axis of the arm portion 17, which position is shown in FIG. 5 as will be described.

Referring to FIG. 5, first and second sheets 121 and 122 of a work piece are shown inclined at an angle 124 to each other when viewed endwise of the clamp which is shown diagrammatically in position. In this particular instance, the sheet 121 is an outer panel of an automobile body which has been displaced and requires working for re-positioning, and the sheet 122 is an inner panel or member which is in its correct location. When the two panels are of similar thickness and generally similarly supported, to ensure that the displaced outer panel moves in preference to the correctly located inner panel, it is important to disperse load to reduce unit loading on the correctly located inner panel. Unit loading on the correctly located second sheet 122 can be reduced by providing a load dispersal pad 126 which can be a piece of plywood several times larger than the pad 25, which is secured by fasteners, not shown, passing through the openings 29 of the pad 26. The plane of symmetry 87 of the clamp is disposed generally perpendicularly to the second sheet 122, so that the pad 126 secured to the contact pad 26 is parallel to and in close contact with an adjacent area of the inner surface of the sheet 122. In contrast, due to the angle 124, the contact pad 25 is swivelled with respect to the outer arm portion 20 about the axis 96 (which is within the plane 87), so that the work surface 27 is generally parallel to an inner face of the first sheet 121. To reduce chances of the pad 25 slipping with respect to the sheet 121, an elastomeric friction pad 128 can be releasably attached to the pad 25 to increase friction between the pad and the sheet 121 so as to maintain the position as shown in FIG. 5. The pad 128 can be generally complementary to the pad 125 so as to be releasably retained thereon by edges of the friction pad 28 embracing edges of the pad 25 as shown. Clearly, area of the pad 128 is much smaller than area of the pad 126 to ensure that the sheet 121 is subjected to greater working pressure to ensure that it deforms preferentially as previously described. The operator does not require to adjust the position of the pad 25, as the pad 25 has sufficient mobility with respect to the arm to self-align itself with the surface of the sheet 121, particularly as greater forces applied. While lightly holding the first and second handle portions with one hand, the operator can adjust the adjusting screw 56 with the remaining hand so that the pads are urged against the surfaces. The second handle portion is released by shifting the releasing lever 72 and is then swung to a partially open position as shown in broken outline at 14.1 thus releasing the pads slightly from the sheets 121 and 122. The screw 56 is then screwed a little further into the second handle portion, while ensuring that the pads 126 and 128 are maintained as closely as possible against the respective surfaces as required. The handle portions are then squeezed by the remaining hand so that the pads move outwardly and the clamp assumes the locked position generally as shown in full outline in FIG. 4.

As the handle portions approach each other to the locked position, a steadily increasing outwardly directed force is applied to the arm portions 17 and 18, which increases bearing forces between the pads and the surfaces by an amount depending on position of the screw 56 and on the compounding effect providing the mechanical advantage inherent in this type of clamp. Adjusting the handle in this manner is a preferred way of applying sufficient force to the pads to locate the pads firmly against the work piece. In this locked position, if there is sufficient force applied by the pads, the locked clamp will remain in place on the workpiece and the operator can remove his hand from the handle portions, thus freeing both hands so that additional work can be performed. For example, when the clamp is securely located, hammer or mallet blows can be applied to the appropriate sheet 121 requiring work, with the adjacent pad 25 held against it acting as an anvil. Alternatively, mechanical magnification of spacing and forces between the pads can be used to apply a series of incrementally increasing outwardly directed forces to the panels by sequentially releasing the releasing lever incrementally tightening the screw 56, and then squeezing the handle portions together again from the partially open positions. This sequence of adjusting the screw and squeezing the handle portions together provides a means for applying a series of outwardly directed forces at an incrementally increasing spacing between the pads, and at a magnitude dependent on the screw position, geometry of the hand plier assembly, and length of the arm portions 17 and 18. Mechanical force magnification in the present invention is determined mainly by length of the arm portions 17 and 18, which are relatively long when compared with the relatively short jaws of the "Vise Grip" pliers. Nevertheless, because most modern automobile body panels are made from relatively thin gauge material, an operator can usually squeeze the handle portions with sufficient force for the appropriate pad to displace the dented panel.

It can be seen that the clamp of the invention operates on a pair of spaced apart surfaces in a manner generally similar to, but also opposite to, squeezing a work piece between jaws of a conventional "Vise Grip". Thus, in the invention the pads are forced outwardly, in contrast to inwards force applied by the jaws of a "Vise Grip". Similarly to a conventional "Vise Grip", the clamp of the invention is actuated by squeezing the handle portions together, which are then released from the work piece by shifting the releasing lever 72 outwardly of the clamp towards the second handle portion From the above, it can be seen that the relative positions of the arm hinge 45, the handle hinge 52, the latch hinge 65, the projection 71, adjacent portions of the releasing lever 72, and the inner end 59 of the adjustable screw 56 serve as a locking means for locking the arm portions engaged with the work piece when the handle portions are moved towards each other. The locking means cooperates with the handle portions and the releasing means to permit the arm portions to be locked on and to be released from engagement with the work piece as described. It can be seen that the locking means have handle stop means, that is the projection 71, for stopping inwards movement of the handle portions when an inwards force is applied to the handle portions to move them towards each other to attain the locked position of the clamp. In addition, it can be seen that the adjusting screw 56 serves as adjusting means for adjusting relative positions of the handle portions when locked by the locking means. Thus the locking means also includes the first handle portion 13 having the adjusting means, i.e. the screw 56, which provides an adjustable latch stop means to engage the first end portion 61 of the latching member, the latch stop means being adjustable by moving longitudinally along the first handle portion by rotating the screw 56 relative thereto. Thus, the locking means are also adjustable so as to vary position of the contact pads when the arms are moved towards a locked position to accommodate work pieces having a different spacing between oppositely facing surfaces.

In addition, it can be seen that the second handle portion 14 has the releasing lever 72, which serves as a releasing means for releasing the handle portions from the locked position. The releasing means cooperates with the handle stop means, i.e., the projection 71 and related structure, so that when the releasing means is inactive, i.e. the lever 72 is retracted against the portion 14, the stop means and thus the locking means can be activated and the arm portions can be locked to engage the work piece. The releasing means is activated by moving the stop means or projection 71 away from the handle portion 14 by rotating the lever 72 which causes the stop means to shift to an inactive position and force of the arm portions on the work piece is released. It can be seen that the relative positions between the first end portion of the latching member 60, the second end portion 62 at the latch hinge 65, the handle hinge 52 and the contact between the projections 71 and inner end 74 of the releasing lever are critical to provide the locking means which functions as follows. When the handle portions are moved towards each other as the pads engage the work piece, the locking means over-centres so as to lock the handle portions in the locked position. Over-centering occurs when the latch hinge pin 67 passes in an inwards direction across a straight latch line, not shown, connecting an axis of the hinge pin 50 to the latch stop means, i.e. the end 59 or the end portion 61, so as to lock the handle in the locked position. As this over-centering action is identical to that found in the well known "Vise Grip" pliers, further description is deemed necessary.

I claim:

1. A lockable spreader clamp comprising:

(a) first and second handle portions for gripping by an operator to move to a locked position of the clamp;

(b) first and second arm portions hinged for relative rotation about an arm hinge having an arm hinge axis, each arm portion having respective outer and inner arm portions, the outer arm portions having contact pads thereon for engaging a work piece, the arm portions locating the contact pads symmetrically relative to each other so that generally adjacent oppositely facing edges of the pads can be positioned to be generally coplanar with each other so as to reduce asymmetrical forces on the arms when the pads engage the work piece, an inner portion of the first handle portion and the first inner arm portion being rigidly connected together to form an essentially rigid, unitary, generally aligned elongated structure, and an inner portion of the second handle portion being hinged to the second inner arm portion at a handle hinge having a handle hinge axis to permit hinged relative movement thereabouts, so that movement of the handle portions towards each other causes the outer arm portions to move away from each other;

(c) locking means for locking the arm portions in the locked position engaged with the work piece when the handle portions are moved towards each other, and (d) releasing means for releasing the handle portions from the locked position, the releasing means cooperating with the handle portions and the locking means to permit the arm portions to be released from engagement with work piece.

2. A clamp as claimed in claim 1, in which:

(a) one of the arm portions has a clearance means to receive the other arm portion passing therethrough.

3. A clamp as claimed in claim 2, in which:

(a) the clearance means is an opening in the second arm portion which has a size to receive the first arm portion passing freely therethrough.

4. A clamp as claimed in claim 1, in which:

(a) the contact pads are coupled for rotation with respect to the respective arm portions to accommodate shape of the work piece when clamped thereagainst.

5. A clamp as claimed in claim 1, in which:

(a) the first and second arm portions are hinged for relative rotation about an arm hinge having an arm hinge axis;

(b) one contact pad is hinged for rotation about a pad axis disposed parallel to the arm hinge axis; and (c) the remaining contact pad is hinged for rotation about a universal joint having a first swivel axis disposed normally to the arm hinge axis, and having second and third swivel axes disposed mutually perpendicularly thereto.

6. A clamp as claimed in claim 1, further including:

(a) resilient means for resiliently urging the contact pads towards each other.

7. A clamp as claimed in claim 6, in which:

(a) the resilient means extends between the second arm portion and an adjacent portion of the essentially rigid unitary elongated structure.

8. A clamp as claimed in claim 7, in which:

(a) the resilient means is a tension coil spring.

9. A clamp as claimed in claim 1, in which:

(a) the locking means have handle stop means for stopping inwards movement of the handle portions when an inwards force is applied to the handle portions to move them towards each other to attain the locked position of the clamp.

10. A clamp as claimed in claim 9, in which the locking means for locking the arm portions is characterized by:

(a) a latching member extending between the first and second handle portions, the latching member having the handle stop means thereon;

(b) the releasing means cooperating with the handle stop means so that when the releasing means is inactive, the stop means can be activated and the arms can be locked to engage the work piece, and when the releasing means is activated, the stop means shift to an inactive position and force of the arm portions on the work piece is released.

11. A clamp as claimed in claim 1, in which the locking means for locking the arm portions is characterized by:

(a) the first and second arm portions being hinged for relative rotation about an arm hinge having an arm hinge axis;

(b) a latching member having a first end portion cooperating with the first handle portion, and a second end portion hinged to the second handle portion at a latch hinge having a latch hinge axis for relative rotation thereabout, the latch hinge axis and the arm hinge axis being parallel to each other; and (c) latch stop means for locating the first end portion of the latching member with respect to the first handle portion so that when the handle portions are moved towards each other, the locking means over-centers so that the latch hinge passes a latch line connecting the latch hinge to the latch stop means so as to lock the handle portions in a locked position.

12. A clamp as claimed in claim 11, in which:

(a) the locking means are adjustable so as to vary position of the contact pads when the arms are moved towards a locked position.

13. A clamp as claimed in claim 11, in which the locking means is further characterized by:

(a) the locking means have handle stop means for stopping inwards movement of the handle portions when an inwards force is applied to the handle portions to move them towards each other to attain the locked position of the clamp;

(b) adjusting means for adjusting relative positions of the handle portions when locked by the lock means; and (c) the first handle portion has the adjusting means, the adjusting means providing a latch stop means to engage the first end portion of the latching means, the latch stop means being moveable longitudinally of the first handle portion to vary position of the latching member.

14. A clamp as claimed in claim 13, in which:

(a) the adjusting means is an adjusting screw cooperating with the first handle portion.

15. A clamp as claimed in claim 1, further comprising:

(a) handle stop means for stopping inwards movement of the handle portions when an inwards force is applied to the handle portions to move them towards each other to attain the locked position of the clamp; and (b) adjusting means for adjusting relative positions of the handle portions when in the locked position.

16. A clamp as claimed in claim 15, in which:

(a) the first handle portion has the adjusting means.

17. A clamp as claimed in claim 1, in which:

(a) the first and second arm portions have respective lengths as measured from the arm hinge axis which are greater than corresponding lengths of the first and second handle portions as measured from the arm hinge axis.

* * * * *